US008985837B1

(12) United States Patent
Heimbruch et al.

(10) Patent No.: US 8,985,837 B1
(45) Date of Patent: Mar. 24, 2015

(54) HOPPER WALL MOUNTING FOR CONCRETE VIBRATOR

(75) Inventors: Glenn Heimbruch, Racine, WI (US); John Thomson, Racine, WI (US)

(73) Assignee: Badger Meter, Inc., Milwaukee, WI (US)

( * ) Notice: Subject to any disclaimer, the term of this patent is extended or adjusted under 35 U.S.C. 154(b) by 967 days.

(21) Appl. No.: 13/068,132

(22) Filed: May 3, 2011

Related U.S. Application Data

(60) Provisional application No. 61/343,780, filed on May 4, 2010.

(51) Int. Cl.
*B01F 11/00* (2006.01)

(52) U.S. Cl.
USPC ..... 366/118; 366/119; 366/124; 366/608

(58) Field of Classification Search
CPC ..... B01F 11/00; B01F 11/04; B01F 11/0208; B01F 11/0258; B01F 11/0225
USPC ..... 366/117, 118, 120, 122, 123, 124, 125, 366/126
See application file for complete search history.

(56) References Cited

U.S. PATENT DOCUMENTS

| | | | | | |
|---|---|---|---|---|---|
| 2,993 | A | * | 3/1843 | Lindley et al. | 366/276 |
| 1,548,614 | A | * | 8/1925 | Konigsberg | 266/216 |
| 1,983,368 | A | * | 12/1934 | Hathorn | 277/507 |
| 2,154,208 | A | * | 4/1939 | Corwill | 366/125 |
| 2,187,088 | A | * | 1/1940 | Malan | 366/125 |
| 2,215,888 | A | * | 9/1940 | Swarthout | 366/124 |
| 2,254,448 | A | * | 9/1941 | Pursel | 366/118 |
| 2,559,196 | A | * | 7/1951 | Medved | 99/422 |
| 2,713,998 | A | * | 7/1955 | Eicken | 366/119 |

* cited by examiner

*Primary Examiner* — Tony G Soohoo
(74) *Attorney, Agent, or Firm* — Boyle Fredrickson, S.C.

(57) ABSTRACT

A concrete vibrator for a hopper which feeds concrete to a slip form is mounted to the outer surface of the hopper wall. The vibrator is fixed to the end of a tube which extends into the hopper through a hole in the hopper wall. A rubber isolator molded on the tube is clamped between flanges one of which is welded to the outer surface of the hopper wall.

12 Claims, 2 Drawing Sheets

HOPPER WALL MOUNTING FOR CONCRETE VIBRATOR

CROSS-REFERENCE TO RELATED APPLICATIONS

This application is a continuation of provisional application 61/343,780, filed May 4, 2010.

BACKGROUND OF THE INVENTION

A concrete slip forming machine as for forming a curb and gutter, a median wall, or the like, has a hopper in which concrete is deposited and directed to a slip form mold. One or more concrete vibrators in the hopper deaerate and consolidate the concrete. Presently a mounting structure is welded or bolted to the inner surface of the hopper wall and the vibrator is secured to the mounting structure. The vibrator is typically powered by a hydraulic motor and the pressure and drain hoses for hydraulic fluid extend out over the top of the hopper to a hydraulic pump. The flow of concrete through the hopper causes wear on the hoses; and the hoses and vibrator mounting structure restrict concrete flow. In the event of a vibrator failure, the hopper must be emptied of concrete and a worker has to crawl inside the hopper to remove and replace the vibrator.

BRIEF SUMMARY OF THE INVENTION

In accordance with the invention, a vibrator is mounted at the end of a tube around the hydraulic hoses. The tube extends through the hopper wall. An isolator body, preferably ball-shaped, of resilient material on the tube is clamped to a mounting flange secured to the outside of the hopper wall. The shape of the tube accommodates different sizes and shapes of hoppers. Further features of the invention will appear from the following description and from the drawings.

DETAILED DESCRIPTION OF THE INVENTION

Figure 1:
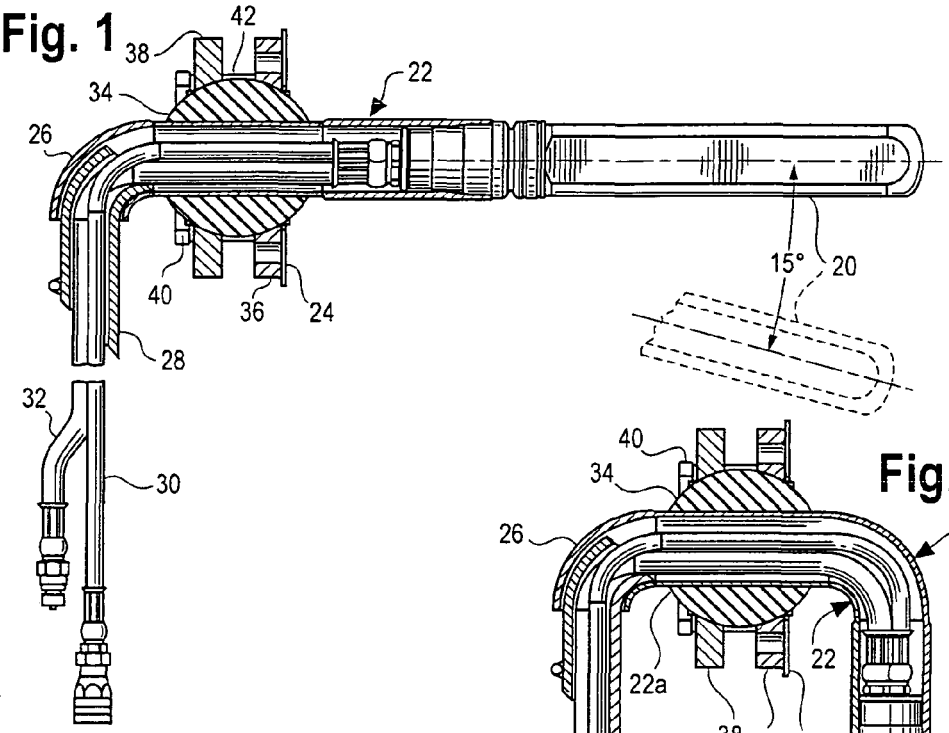
FIG. 1 is a sectional view of one embodiment of vibrator mounted outside a hopper wall.
Figure 4:
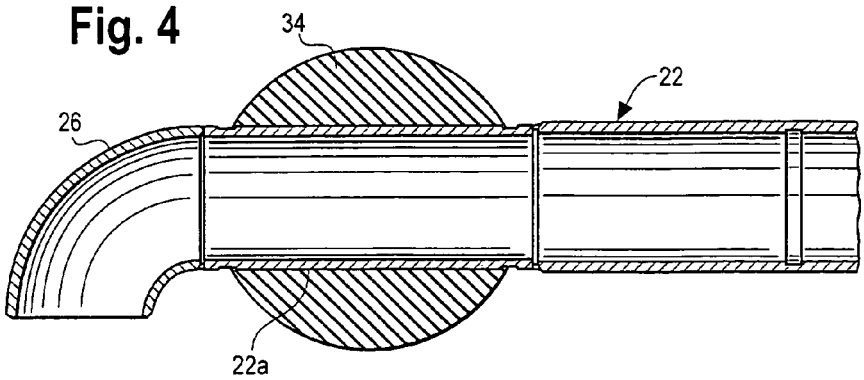
FIG. 4 is a sectional view of the ball and tube of FIG. 1.

The vibrator assembly of FIGS. 1, 4, and 7 comprises a vibrator head 20 secured to the end of a steel tube 22 which extends through an opening in hopper wall 24. Outside the hopper wall, tube 22 terminates in an elbow section 26 and a protective hose 28 for hydraulic pressure and return hoses 30, 32, respectively.

A rubber ball 34 is molded on the center section 22*a*, FIG. 4, of tube 22. The ball is clamped to the hopper wall 24 to mount the vibrator head 20 at the desired position in the hopper. A base flange 36 is welded to hopper wall 24 around the opening in the wall. Cover flange 38 is fastened to base flange 36 with bolts 40, clamping ball 34 between the flanges. Stand-off sleeves 42 around bolts 40 establish repeatable clamping pressure applied to ball 34. A rubber compound with 50 duro ASTM D2000 M4 AA514 A13 B13 C12 F17 has been found satisfactory for isolator ball 34.

Figure 3:
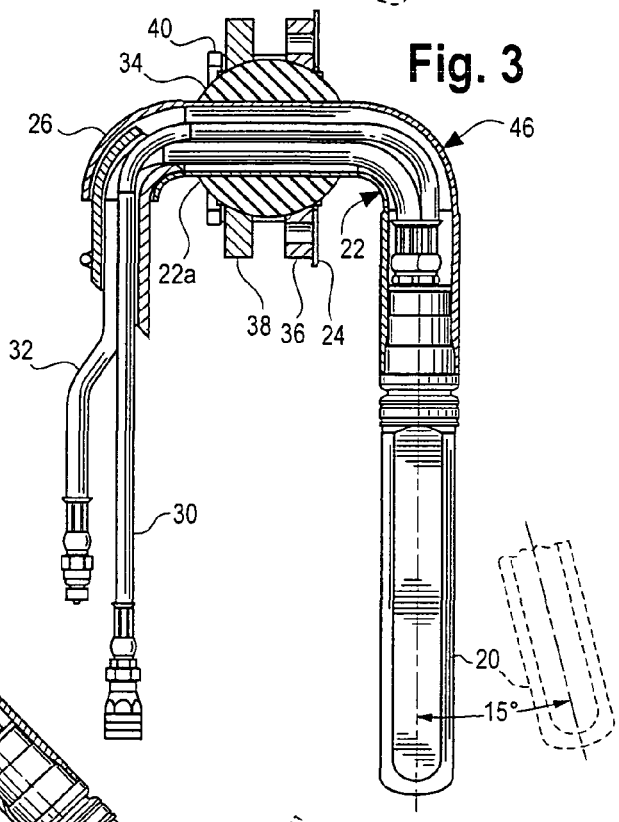
FIG. 3 is sectional view of yet another embodiment of vibrator mounted outside a hopper wall.
Figure 2:
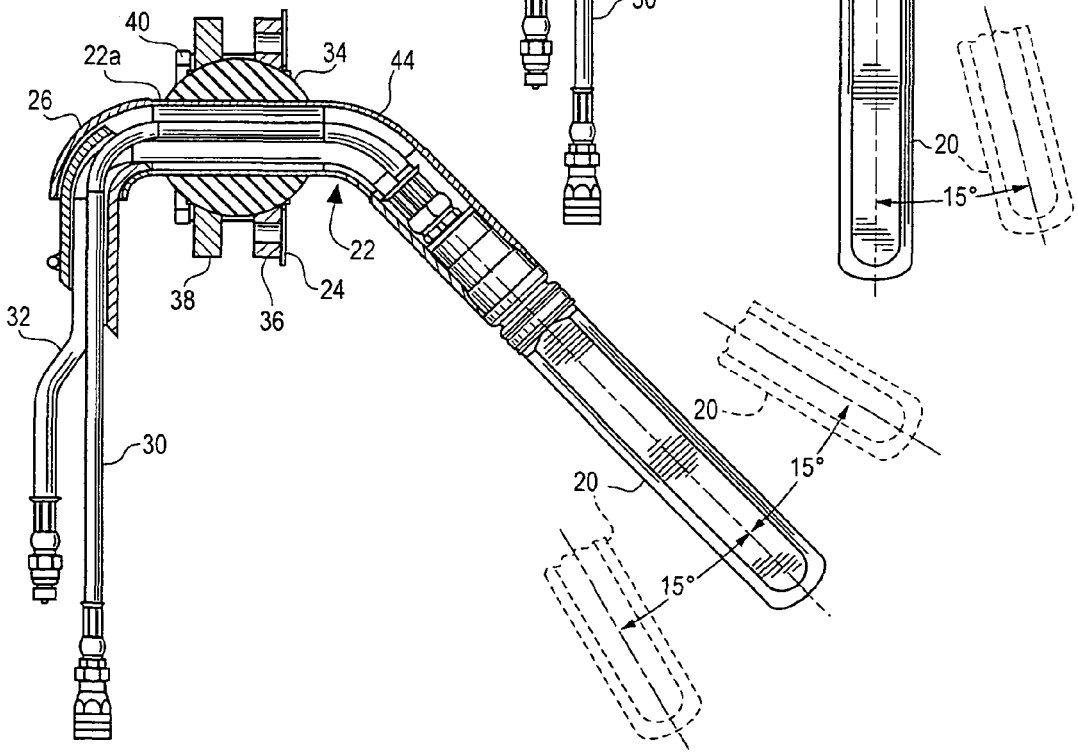
FIG. 2 is a sectional view of another embodiment of vibrator mounted outside a hopper wall.
Figure 5:
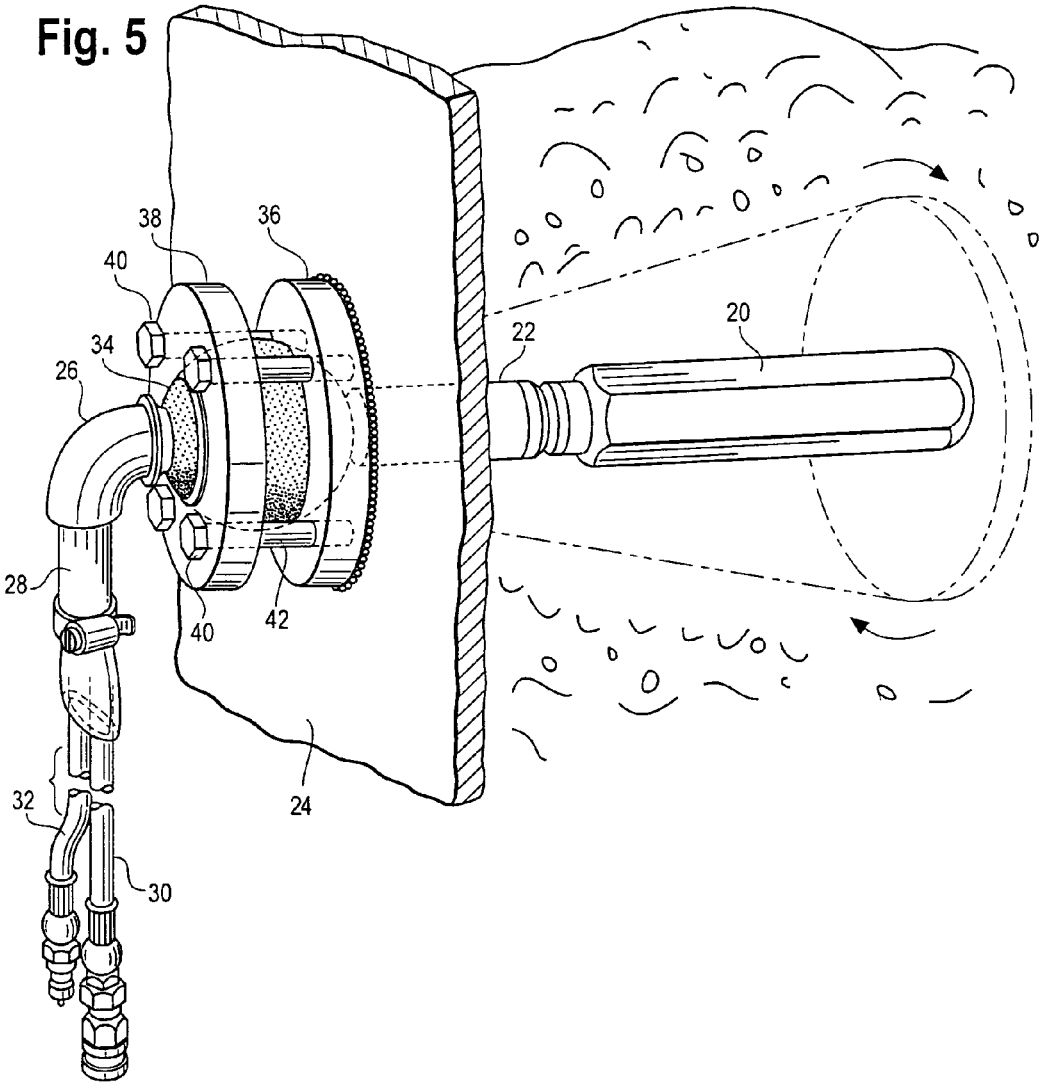
FIG. 5 is a perspective of the vibrator of FIG. 1.

Configurations other than the straight tube 22 of FIGS. 1, 4, and 5 provide a vibrator mounting to fit different shapes of hoppers. A tube 22' with a 45° elbow section 44 is shown in FIG. 2. The tube 22" of FIG. 3 has a 90° elbow section 46 and vibrator head 20 is parallel with the hopper wall 24.

The surface of center section 22*a* of tube 22 where rubber ball 34 is molded is machined to a uniform diameter for a good seal with the rubber. The sections 22*a*, 26, 44, and 46 of sleeve 22 are welded together. Vibrator head 20 is threaded into the end of sleeve 22.

The mounting of ball 34 between flanges 36, 38 permits rotation of the ball 34 and tube 22 about the axis of tube section 22*a*, and thus the position of vibrating head 20 in the hopper. The ball mounting also permits adjustment of the head position toward and away from the hopper wall 24 through a limited arc so long as tube 22 does not engage the hopper wall 24 or base flange 36. Ranges of vibrator positions are indicated in broken lines, FIGS. 1, 2, 3, and 5.

What is claimed is:

1. A vibrator mounting for a concrete hopper having a wall with an outer surface, there being an opening through said wall, comprising a tube enclosing a hydraulic pressure hose and a return hose extending through said opening with an inner end within said hopper and an outer end outside said hopper;

a vibrator in said hopper for mechanically agitating the contents of the hopper when hydraulic pressure is applied through the hydraulic pressure hose, the vibrator connected with the inner end of said tube;

actuation means extending through said tube for actuation said vibrator; and securing means securing said tube to said hopper wall.

2. The vibrator mounting of claim 1 wherein, said securing means secures said tube to the outer surface of said hopper wall.

3. The vibrator mounting of claim 2 further comprising:

a round body on said tube; and said securing means releasably clamps said round body to the outer surface of the hopper wall and, when loosened, enables rotation of said body to adjust the position of said vibrator in said hopper.

4. The vibrator mounting of claim 3 in which said body is ball shaped.

5. The vibrator mounting of claim 2 further comprising;

a body on said tube;

said securing means clamps said body to the outer surface of said hopper wall.

6. The vibrator mounting of claim 5 in which said body is of resilient material.

7. The vibrator mounting of claim 5 in which said securing means comprises:

a base flange secured to the outer surface of said hopper; and cover flange secured to said base flange, said body being clamped between the base flange and the cover flange.

8. The vibrator mounting of claim 7 further comprising:

limiting means for limiting the clamping pressure between said base and cover flanges.

9. The vibrator mounting of claim 8 further comprising:

a plurality of bolts securing said cover flange to said base flange; and stand-off sleeves around each bolt to establish the clamping pressure applied to said body.

10. The vibrator mounting of claim 1 in which:

said tube has a straight section which extends through the opening in the wall of the hopper; and the inner end of said tube extends at an angle from said straight section.

11. The vibrator mounting of claim 10 in which said angle between the straight section and the inner end of said tube extending from the straight section is 45 degrees.

12. The vibrator mounting of claim 10 in which said angle between the straight section and the inner end of said tube extending from the straight section is 90 degrees.

* * * * *